US007143811B2

(12) United States Patent
Rolf et al.

(10) Patent No.: US 7,143,811 B2
(45) Date of Patent: Dec. 5, 2006

(54) LIQUID-COOLED INGOT MOLD

(75) Inventors: Thomas Rolf, Osnabrück (DE); Hans-Günter Wobker, Bramsche (DE); Gerhard Hugenschütt, Belm (DE); Reinhold Burlager, Osnabrück (DE)

(73) Assignee: KM Europa Metal AG, Osnabruck (DE)

( * ) Notice: Subject to any disclaimer, the term of this patent is extended or adjusted under 35 U.S.C. 154(b) by 0 days.

(21) Appl. No.: 11/036,400

(22) Filed: Jan. 14, 2005

(65) Prior Publication Data

US 2005/0150629 A1 Jul. 14, 2005

(30) Foreign Application Priority Data

Jan. 14, 2004 (DE) ..... 10 2004 001 928

(51) Int. Cl.
*B22D 11/04* (2006.01)

(52) U.S. Cl. ..... 164/443; 164/435

(58) Field of Classification Search ..... 164/443, 164/435

See application file for complete search history.

(56) References Cited

U.S. PATENT DOCUMENTS 3,125,786 A * 3/1964 Savage ..... 164/435
3,866,664 A * 2/1975 Auman et al. ..... 164/443
4,100,962 A * 7/1978 Housman ..... 164/435
4,252,178 A * 2/1981 Hudd ..... 164/435
6,289,970 B1 * 9/2001 Fehlemann ..... 164/443
6,863,115 B1 * 3/2005 Hugenschutt et al. ..... 164/418
6,874,564 B1 * 4/2005 Hugenschutt et al. ..... 164/418
2001/0042608 A1 * 11/2001 Streubel et al. ..... 164/418

FOREIGN PATENT DOCUMENTS

DE 195 81 604 3/1997

* cited by examiner

*Primary Examiner*—Len Tran
(74) *Attorney, Agent, or Firm*—Kenyon & Kenyon LLP

(57) ABSTRACT

A liquid-cooled ingot mold is provided for the continuous casting of metals. The mold is made up of mold plates or a chill tube made of copper or a copper alloy, which are connected to a support structure by fastening bolts. The mold plates or the chill tube is connected to the support structure without clamping. A working gap exists between the support structure and the mold plates or the chill tube.

21 Claims, 2 Drawing Sheets

LIQUID-COOLED INGOT MOLD

BACKGROUND OF THE INVENTION

1. Field of the Invention

The invention relates to a liquid-cooled ingot mold for the continuous casting of metals. More particularly, the invention relates to such a mold having mold plates or a chill tube made of copper or a copper alloy, which are connected to a support structure by fastening bolts.

2. Description of Related Art

Mold plates or a chill tube made of copper for continuous casting are usually connected to a support structure by screw connections. The support structure may be a cooling-water tank or an adapter plate. A continuous casting mold for metals is known from DE 195 81 604 T1, in which a uniformly thick mold plate or a chill tube made of copper or a copper material is connected to a support plate made of steel via a plurality of bolts. Particularly in the case of short bolts, the thermally caused expansion of the mold plates or the chill tube in the casting operation results in a non-negligible bending strain and tensile strain in the individual bolts. Depending on the method of fastening the bolts to the mold plate or to the chill tube, there may be a failure of the welded connection in the case of bolts that are welded on, or excessive strain may be exerted on the thread in the case of bolts that are screwed in. In the extreme case, even cracks in the mold plate or in the chill tube may occur. To avoid this, DE 195 81 604 T1 provides for the mold plate and the support plate to be bolted together in a sliding arrangement, so that the mold plate or the chill tube is laterally movable relative to the support plate. This is achieved by using sliding fasteners, and by oversizing the through-holes in the support plate. A lateral or two-dimensional movement of the bolts, and consequently of the mold plate or the chill tube, is possible. In addition to this measure, disk-shaped spring washers are proposed, preferably in a stacked arrangement, in order to maintain the initial tension of the bolt even at high temperatures. In this context, the spring washers are used from the perspective of gear technology as a hinging system having a degree of freedom, that is, as a sliding fit. This solution has the disadvantage that the use of steel spring washers generates a considerable static friction between the spring elements. Due to the plurality of contact surfaces between the spring washers as well as the support plate and the mold plate or the chill tube, the static friction forces add up, so that a stress-free relative displacement of the mold plate/chill tube is impossible. Fundamentally, however, the superposition of the thermally and mechanically induced stresses results in an increased strain on the mold plate or the chill tube, which eventually results in a premature failure and a reduction in the service life of the ingot mold.

SUMMARY OF THE INVENTION

It is an object of the invention to improve a liquid-cooled ingot mold for the continuous casting of metals so as to allow for a largely stress-free lateral displacement/deformation of the mold plate or the chill tube relative to a support structure.

These and other objects of the invention are achieved by a liquid-cooled ingot mold for the continuous casting of metals, having mold plates (1) or a chill tube made of copper or a copper alloy, which are connected to a support structure (2) by fastening bolts (6, 19), wherein the mold plates (1) or a chill tube and the support structure (2) are connected to each other by the fastening bolts (6, 19) without clamping, and there is a working gap (18) existing between the support structure (2) and the mold plates (1) or the tube.

BRIEF DESCRIPTION OF THE DRAWINGS

The invention will be described in greater detail with reference to the following drawings, wherein.

DETAILED DESCRIPTION OF THE INVENTION

Figure 1:
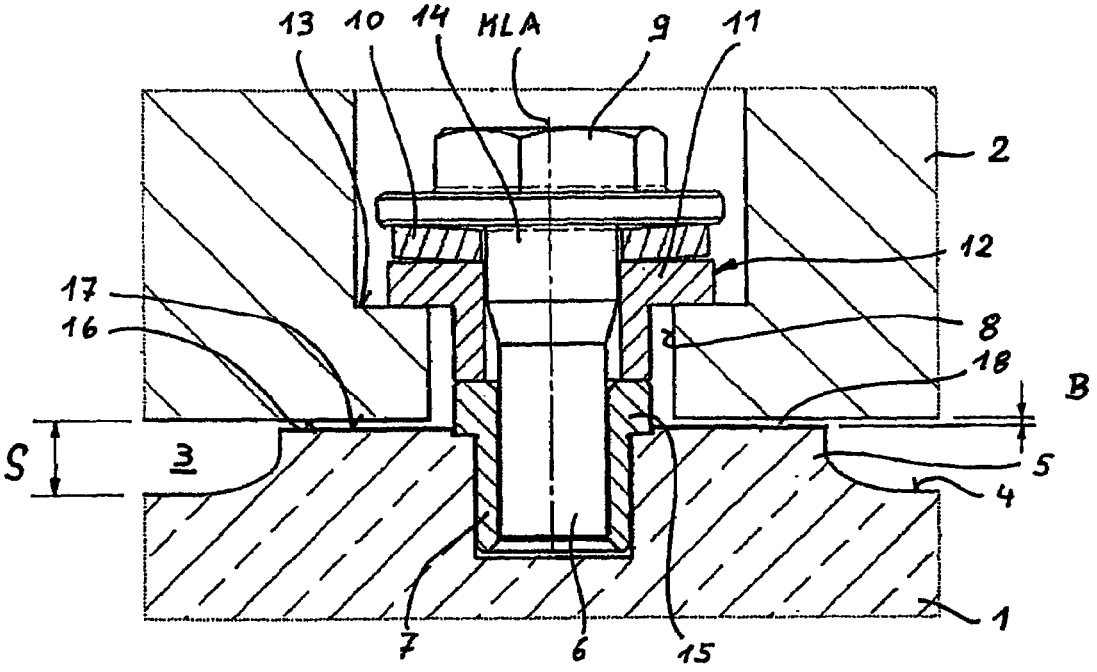
FIGS. 1 and 2 illustrate a cross section of a support plate and a mold plate in the area of a screw connection, the mold plate assuming two different relative positions with respect to the support plate.

It is characteristic for the ingot mold according to the present invention that the mold plate or the chill tube and the support structure are connected by the fastening bolts without clamping. That is to say, a working gap exists between the support structure, which can be a cooling-water tank, an intermediate plate or an adapter plate for example, and the mold plate or chill tube attached to it. Within the framework of manufacturing possibilities, the width of this working gap is chosen to be as small as possible, it being necessary to ensure only that the mold plate/chill tube and the support structure are connected without clamping. In the region of the working gap, the mold plate/chill tube is situated at a distance from the support structure. Fundamentally it is provided that the mold plate/chill tube can be displaced to a limited extent laterally, that is, essentially parallel with respect to the support structure. This is achieved by oversizing the through-holes in the support structure or a support plate. It is essential, however, that due to the working gap, the mold plate/chill tube can be displaced in this lateral plane of movement without clamping. Of course, the width of the working gap is limited as much as possible also to prevent the mold plate/chill tube from being raised by more than a maximum distance from the support structure and from being displaced in the direction of the mold cavity formed by the ingot mold.

Particularly in the formation of a working gap between the mutually facing surfaces of the mold plate/chill tube and the support structure, it is possible that there is no direct contact between the mold plate/chill tube and the support structure since these are generally arranged with respect to each other at a distance of at least the width of the working gap.

The working gap preferably has a width that is smaller than $2/10$ mm. Most preferably, the working gap has a width of less than $1/10$ mm. The working gap exists at room temperature as well as during the casting process. If the mold plate/chill tube is pressed against the support structure by the clamping forces and the ferrostatic pressure in the ingot mold, then the working gap is possibly displaced to the side of the support structure that is facing away from the mold plate/chill tube, that is, into the region between a bolt head or a screwed on nut and the support structure. This case also involves no clamping. Only the friction force between the mutually facing surfaces of the mold plate/chill tube and the support structure occurring as a function of the normal force must be overcome.

The fastening bolts are preferably threaded bolts which can be screwed into the mold plates/chill tube down to a defined screw-in depth. These threaded bolts have a bolt head that functions as a stop. To be able to form a working gap it is necessary that the bolt head does not fall short of a minimum distance from the mold plate/chill tube. A limiting means is therefore provided to limit the screw-in depth of the threaded bolt and thus to define the width of the working gap. In a specific embodiment the screw-in depth is limited by a clamping sleeve, which is clamped between the bolt head of the threaded bolt and the mold plate/chill tube. The clamping sleeve is a separate component, the length of which is adjusted exactly to the desired distance of the bolt head and the mold plate/chill tube. In this arrangement, the fastening bolt merely clamps the clamping sleeve and not the region of the support structure surrounding the clamping sleeve.

In another specific embodiment, the threaded bolt is not screwed directly into the relatively soft mold plate/chill tube, but rather into a threaded insert fastened to the mold plate/chill tube. So as not to put a strain on the connection between the mold plate/chill tube and the threaded insert, there is a provision for supporting the clamping sleeve directly on the threaded insert.

Fundamentally, it is also possible within the framework of the invention that the fastening bolts are threaded bolts connected to the mold plate/chill tube, which is to say that the threaded bolts can be attached to the mold plate/chill tube in a permanent or detachable manner, e.g. by welding or bolting. These threaded bolts can be secured to the support structure with the aid of nuts, the nuts in turn being capable of being screwed onto the threaded bolts up to a defined distance to the mold plates/chill tube. The distance of the nut from the mold plate/chill tube in turn can be defined by a clamping sleeve that can be clamped between the mold plate/chill tube and the nut. Generally it is also possible within the framework of the present invention to define the distance between the nut and the backside of the mold plate/chill tube by a limiting means on the threaded bolt. A limiting means, for example, may be a turned stub on the threaded bolt, for example in the form of a peripheral collar. It is not necessary that the threaded bolts have a thread across their entire length. It may suffice to provide the thread only in the section of the level at which the nuts are to be screwed onto the bolt. In general it is also possible to use threaded bolts that can be screwed in at only one end, this screw-in end being followed by a stop for limiting the screw-in depth. This configuration does not require a separate clamping sleeve. In the reverse case, a nut and a clamping sleeve could form a single component, which is then screwed onto a threaded bolt.

In another specific embodiment, a spring element is arranged between the clamping sleeve and the nut or the bolt head. This spring element is in particular a conical spring washer or also a Belleville spring washer or crinkled spring washer. If due to the deformation of the mold plate or the chill tube during casting or due to other external influences, the working gap between the support structure and the mold plate/chill tube is not provided, the spring element will prevent an inflexible locking of the mold plate/chill tube and the support structure.

In all specific embodiments, the bolt head or the nut is larger in diameter than a through-hole through the support structure, so that the mold plate/chill tube is securely oriented in terms of position. To reduce the friction coefficient between the possible contact surfaces of the mold plate/chill tube or of the fastening bolts bolted to the mold plate/chill tube, sliding aids are provided at the surfaces that can be displaced relative to each other. The sliding aids may be mounted on the support structure as well as on the mold plate/chill tube of a clamping sleeve. The sliding aid may in particular be a coating based on polytetrafluoroethylene (PTFE). The use of sliding disks is also possible.

It is essential for a relative movement between the mold plate or the chill tube and the support structure in the region of the individual connections that the fastening bolts or the clamping sleeves surrounding the fastening bolts allow for such a relative displacement. In general, the fastening bolts pass through the through-holes of the support structure with sufficient radial play.

It is regarded as particularly advantageous if in the context of the present invention the desired working gap is maintained by an overpressure built up by a coolant flow between the mold plate/chill tube and the support structure in such a way that the pressure of the coolant pushes the mold plate/chill tube away from the surface of the support structure. Even if coolant can enter into the working gap, the working gap in the sense of the present invention does not take the form of a coolant channel, but has a substantially narrower width. At most, the working gap is located between ridges delimiting the coolant channels. In general it is possible within the framework of the present invention, that only subsections of the mold plate/chill tube are connected to each other without clamping in the sense of the present invention so as to allow for relative movements in subsections in which a particularly high thermal load is to be expected, while another type of fastening is chosen in other subsections of the mold plate/chill tube. In this manner it is also possible to produce a fixed bearing or a fixed bearing region having a high rigidity of connection between the mold plate/chill tube and the support structure or a floating bearing or a floating bearing region having a low rigidity of connection. On the basis of a connection region of higher rigidity, a thermally caused expansion of the mold plate/chill tube can occur in regions that have low friction values or that are even connected without clamping, as provided within the framework of the present invention.

FIG. 1 shows a partial section of a mold plate 1 fastened to a support plate 2 as part of a support structure. The mold plate and support plate 2 form a plate unit of a liquid-cooled mold for the continuous casting of metals that is not shown in greater detail. Mold plate 1 is made of copper or a copper alloy, preferably having a yield point greater than 350 MPa. For cooling mold plate 1, a coolant gap 3 is situated between support plate 2 and mold plate 1. Coolant gap 3 is located in mold plate 1 and is determined with regard to its width S by the height of plateau pedestals 5 projecting like islands on the coolant side 4 of mold plate 1. Plateau pedestals 5 can have a streamlined shape and have coolant flowing around them. In this exemplary embodiment, plateau pedestals 5 are formed in one piece with mold plate 1. A fastening bolt 6 engages into the represented plateau pedestal 5 of mold plate 1. To this end, a threaded insert 7 is anchored in plateau pedestal 5, into which fastening bolt 6 is screwed.

Fastening bolt 6 passes through a through-hole 8 in support plate 2. Shaped as an external hexagon, bolt head 9 of fastening bolt 6 is supported via a conical spring washer 10 and a collar 11 of a clamping sleeve 12 on a rear stop face 13 of support plate 2. Clamping sleeve 12 extends into through-hole 8 and is centered by shaft 14 of threaded bolt 6. It rests on a ring section 15 of threaded insert 7. In this exemplary embodiment, ring section 15 likewise extends into through-hole 8. The length of ring section 15, clamping sleeve 12 and conical spring washer 10 extending in the direction of the middle longitudinal axis MLA of through-hole 8 or of fastening bolt 6 is dimensioned in such a way that a working gap 18 of a small width B remains between the facing surfaces 16, 17 of support plate 2 and mold plate 1. In the area of this screw connection, mold plate 1 does not rest against support plate 2.

Figure 2:
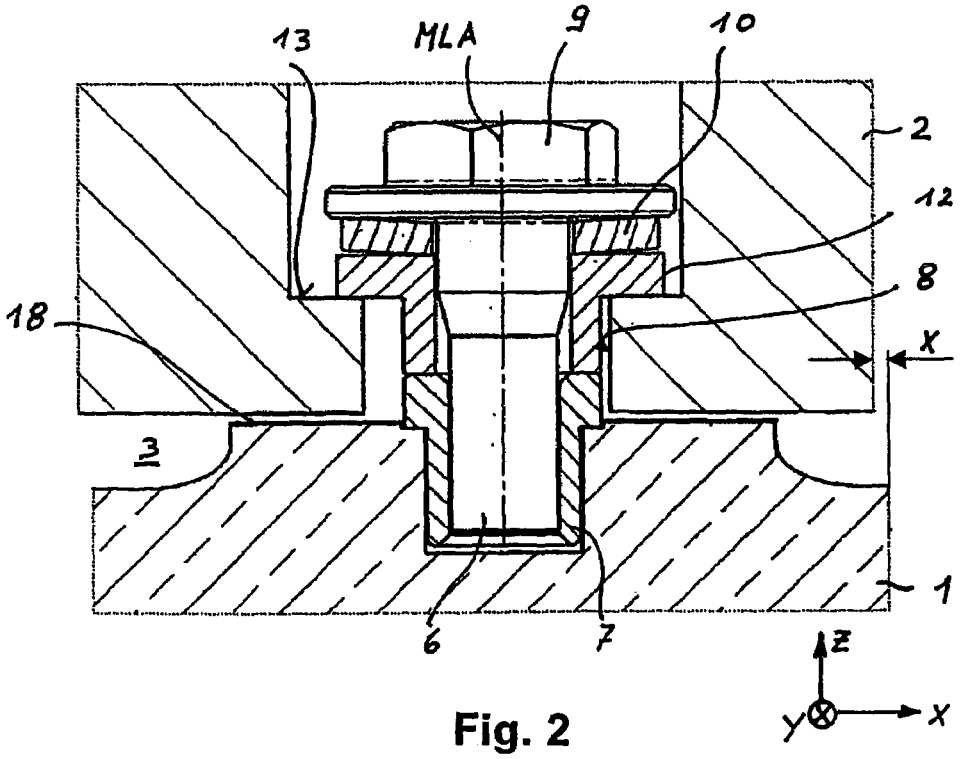

FIG. 2 shows the partial section of FIG. 1, mold plate 1 having been laterally displaced with respect to support plate 2. Here the width B of working gap 18 has remained the same. The displacement occurs by an increment X according to the X direction in the Cartesian coordinate system shown in the drawing. A displacement in the Y direction is possible in the same manner, the degree of the displacement being determined by the oversize of through-hole 8. The Z direction corresponds to a displacement of mold plate 1 in the direction of the support structure or support plate 2, that is, in the direction of middle longitudinal axis MLA of fastening bolt 6. By the narrow working gap, the displacement in the Z direction is to be kept as small as possible and is smaller than the displacement in the X and Y directions.

Figure 3:
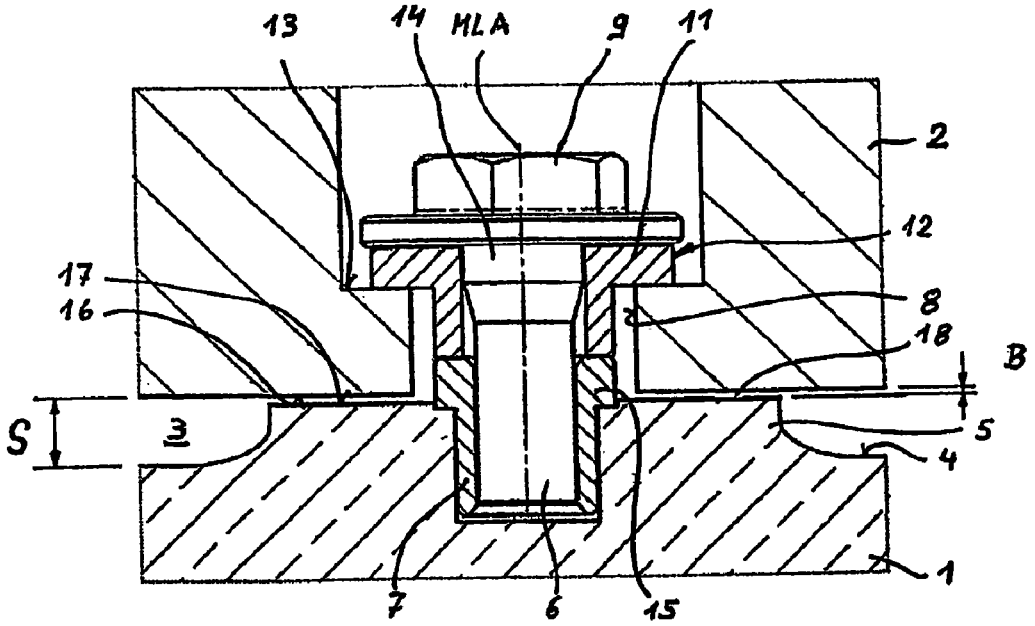
FIG. 3 is a cross section of a mold plate and a support plate in the area of a screw connection in a second specific embodiment.

The specific embodiment of FIG. 3 differs from that of FIGS. 1 and 2 in that a conical spring washer is not provided and bolt head 9 rests directly on collar 11 of clamping sleeve 12. Shaft 14 of threaded bolt 6 is accordingly designed to be shorter.

Figure 4:
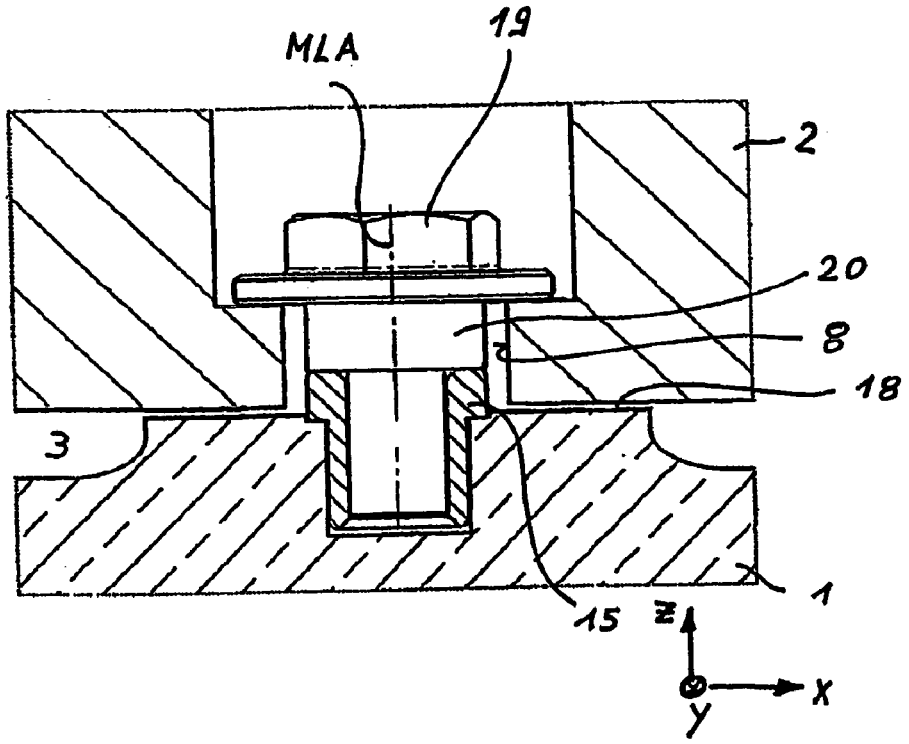
FIG. 4 is a cross section of a mold plate and a support plate in the area of a screw connection in a third specific embodiment.

The specific embodiment of FIG. 4 differs from that of FIG. 1 in that is has a differently shaped fastening bolt 19. This fastening bolt 19 has a cylindrical shaft 20 extending into through-hole 8, which acts as a clamping sleeve so to speak. The length of shaft 20 is dimensioned in such a way that, when fastening bolt 19 is screwed in, it rests directly against ring section 15 of threaded insert 7. In this manner, the conical spring washer is eliminated on the one hand and the clamping sleeve on the other. Installation is very fast and simple. The variety of parts is reduced. In this specific embodiment, the outer diameter of shaft 20 is also chosen to be smaller than the inner diameter of through-hole 8 so as to allow for a lateral displacement of mold plate 1 with respect to support plate 2 in the X and Y directions. The width B of working gap 18 is determined by the longitudinal adjustment of the ring section, of shaft 20, and of the length of through-hole 8 and is exactly defined.

LIST OF REERENCE CHARACTERS

1—Mold plate
2—Support plate
3—Coolant gap
4—Coolant side
5—Plateau pedestal
6—Fastening bolt
7—Threaded insert
8—Through-hole in 2
9—Bolt head
10—Spring element (conical spring washer)
11—Ring section
12—Clamping sleeve
13—Stop face
14—Shaft of 6
15—Ring section of 7
16—Surface of 2
17—Surface of 2
18—Working gap
19—Fastening bolt
20—Shaft of 19
MLA—Middle longitudinal axis of 6, 20
B—Width of 18
S—Width of 3

What is claimed is:

1. A liquid-cooled ingot mold for the continuous casting of metals, comprising mold plates (1) or a chill tube made of copper or a copper alloy, which are connected to a support structure (2) by fastening bolts (6, 19), wherein the mold plates (1) or the chill tube are connected to the support structure (2) by fastening bolts (6, 19), wherein a working gap (18) is defined between the support structure (2) and the mold plates (1) or the tube that assures a load/stress-free positioning of the mold plates (1) or the chill tube against the support structure (2), wherein the ingot mold is free of components, between the mold plates (1) or chill tube and the support structure (2), which contact opposing surfaces of the mold plates (1) or chill tube and the supporting structure (2) that face each other.

2. The ingot mold according to claim 1, wherein the working gap (18) is situated between mutually facing surfaces (16, 17) of the mold plate (1) or the chill tube and the support structure (2).

3. The ingot mold according to claim 1, wherein the width (B) of the working gap (18) is smaller than 0.2 mm.

4. The ingot mold according to claim 1, wherein the fastening bolts (6, 19) are threaded bolts that can be screwed into the mold plates (1) or the chill tube down to a defined screw-in depth.

5. The ingot mold according to claim 2, wherein the fastening bolts (6, 19) are threaded bolts that can be screwed into the mold plates (1) or the chill tube down to a defined screw-in depth.

6. The ingot mold according to claim 3, wherein the fastening bolts (6, 19) are threaded bolts that can be screwed into the mold plates (1) or the chill tube down to a defined screw-in depth.

7. The ingot mold according to claim 4, wherein the screw-in depth is limited by a clamping sleeve (12), which is clamped between a bolt head (9) of the threaded bolts (5) and the mold plate (1) or the chill tube.

8. The ingot mold according to claim 5, wherein the screw-in depth is limited by a clamping sleeve (12), which is clamped between a bolt head (9) of the threaded bolts (5) and the mold plate (1) or the chill tube.

9. The ingot mold according to claim 6, wherein the screw-in depth is limited by a clamping sleeve (12), which is clamped between a bolt head (9) of the threaded bolts (5) and the mold plate (1) or the chill tube.

10. The ingot mold according to claim 7, wherein the threaded bolt (6) is screwed into a threaded insert (7) in the mold plate (1) or the chill tube, and wherein the clamping sleeve (12) rests on the threaded insert (7).

11. The ingot mold according to claim 8, wherein the threaded bolt (6) is screwed into a threaded insert (7) in the mold plate (1) or the chill tube, and wherein the clamping sleeve (12) rests on the threaded insert (7).

12. The ingot mold according to claim 9, wherein the threaded bolt (6) is screwed into a threaded insert (7) in the mold plate (1) or the chill tube, and wherein the clamping sleeve (12) rests on the threaded insert (7).

13. The ingot mold according to claim 1, wherein the fastening bolts are threaded bolts attached to the mold plate or the chill tube, the threaded bolts being secured by nuts, which can be screwed onto the threaded bolts up to a defined distance with respect to the mold plate/chill tube.

14. The ingot mold according to claim 2, wherein the fastening bolts are threaded bolts attached to the mold plate or the chill tube, the threaded bolts being secured by nuts, which can be screwed onto the threaded bolts up to a defined distance with respect to the mold plate/chill tube.

15. The ingot mold according to claim 3, wherein the fastening bolts are threaded bolts attached to the mold plate or the chill tube, the threaded bolts being secured by nuts, which can be screwed onto the threaded bolts up to a defined distance with respect to the mold plate/chill tube.

16. The ingot mold according to claim 13, wherein the distance is defined by a clamping sleeve clamped between the mold plate/chill tube and the nut.

17. The ingot mold according to claim 13, wherein the distance is defined by a limiting means on the threaded bolt.

18. The ingot mold according to claim 7, wherein a spring element (10) is arranged between the clamping sleeve (12) and the nut or the bolt head (9).

19. The ingot mold according to claim 16, wherein a spring element (10) is arranged between the clamping sleeve (12) and the nut or the bolt head (9).

20. The ingot mold according to claim 18, wherein the spring element (10) is a conical spring washer.

21. The ingot mold according to claim 19, wherein the spring element (10) is a conical spring washer.

* * * * *